US008851645B2

(12) United States Patent
Nagasawa et al.

(10) Patent No.: US 8,851,645 B2
(45) Date of Patent: Oct. 7, 2014

(54) LIQUID CONTAINER

(71) Applicants: Satoru Nagasawa, Tokyo (JP); Tomonori Tamura, Kanagawa (JP)

(72) Inventors: Satoru Nagasawa, Tokyo (JP); Tomonori Tamura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/859,303

(22) Filed: Apr. 9, 2013

(65) Prior Publication Data

US 2013/0278685 A1 Oct. 24, 2013

(30) Foreign Application Priority Data

Apr. 23, 2012 (JP) ..... 2012-097719

(51) Int. Cl.
*B41J 2/175* (2006.01)
*B41J 29/393* (2006.01)

(52) U.S. Cl.
CPC ..... *B41J 2/1752* (2013.01); *B41J 2/17536* (2013.01); *B41J 2/17553* (2013.01); *B41J 2/17523* (2013.01)
USPC ..... 347/86; 347/19

(58) Field of Classification Search
USPC ..... 347/7, 19, 85, 86, 87
See application file for complete search history.

(56) References Cited

U.S. PATENT DOCUMENTS

| | | | | |
|---|---|---|---|---|
| 5,992,975 | A * | 11/1999 | Gasvoda et al. | 347/50 |
| 6,702,427 | B2 * | 3/2004 | Shimizu et al. | 347/50 |
| 6,913,168 | B2 * | 7/2005 | Lawson et al. | 222/153.13 |
| 7,128,244 | B2 * | 10/2006 | Antal, Sr. | 222/153.01 |
| 7,226,154 | B2 | 6/2007 | Seino et al. | |

FOREIGN PATENT DOCUMENTS

| | | |
|---|---|---|
| JP | 4111089 | 7/2008 |
| JP | 2010-058525 | 3/2010 |
| JP | 2010-076343 | 4/2010 |
| JP | 2010-253688 | 11/2010 |
| JP | 4843112 | 12/2011 |

OTHER PUBLICATIONS

U.S. Appl. No. 13/746,639, filed Jan. 22, 2013.

* cited by examiner

*Primary Examiner* — Anh T. N. Vo
(74) *Attorney, Agent, or Firm* — Cooper & Dunham LLP

(57) ABSTRACT

A liquid container contains liquid to be supplied to a body of an image forming apparatus. The liquid container includes a liquid supply port part having a liquid supply port supplying the contained liquid and a cap member mounted on the liquid supply port part. The cap member has a sealing part sealing the liquid supply port and a holding part holding an information storage device storing information concerning the liquid. The sealing part and the holding part are separably connected together. When the cap member is mounted on the liquid supply port while the sealing part and the holding part are connected, the holding part is immovably fixed to the liquid supply port via the sealing part. When the sealing part has been separated from the holding part, the holding part comes to be able to move with respect to the liquid supply port.

10 Claims, 10 Drawing Sheets

LIQUID CONTAINER

BACKGROUND OF THE INVENTION

1. Field of the Invention

The present invention relates to a liquid container, and in particular, to a liquid container that contains liquid to be supplied to an image forming apparatus that has a recording head discharging liquid droplets.

2. Description of the Related Art

As an image forming apparatus such as a printer, a facsimile machine, a copier, a plotter, a multifunction peripheral having functions thereof, a printing machine or the like, an image forming apparatus of a liquid discharge recording type is known which uses a recording head containing liquid discharge heads (liquid droplet discharge heads) discharging liquid droplets, for example.

In such an image forming apparatus, for the purpose of being able to carry out continuous printing for a long time, a liquid cartridge as a liquid container for containing liquid is known which is replaceable for an apparatus body, and also, includes a contact-type information storage device (an IC chip or so) that stores information (the remaining amount, the type and/or the like) concerning the liquid contained in the liquid container.

In a case of using such a contact-type information storage device, an exchange of information can be carried out between the liquid cartridge and the side of the apparatus body, as a result of the liquid cartridge being attached to the side of the apparatus body and a reading unit of the side of the apparatus body coming into contact with the information storage device of the liquid cartridge.

For this purpose, it is necessary that when the liquid cartridge is attached to the apparatus body, the information storage device and the reading unit of the side of the apparatus body positively come into contact with one another.

Therefore, such a configuration is known that, for example, the information storage device is movably held in the side of the liquid cartridge, and a projection in the side of the apparatus body is inserted into a hole or the like of a substrate having the information storage device, whereby positioning is made between the information storage device and the reading unit of the apparatus body (see Patent Reference No. 1 (Japanese Patent No. 4843112), Patent Reference No. 2 (Japanese Patent No. 4111089) and Patent Reference No. 3 (Japanese Laid-Open Patent Application No. 2010-58525)).

However, in a commercial printing machine such as a large-size continuous form printing machine or the like, for example, as an image forming apparatus, both high productivity and low cost are required. For this purpose, it is necessary to increase the capacity of the liquid cartridge for the purpose of making it possible to carry out continuous printing for a long time. On the other hand, in order to make it possible to reduce the cost by reducing the downtime of the printing machine, it is required to be able to replace the liquid cartridge easily.

In order to make it possible to be able to easily replace the liquid cartridge having the large capacity, the clearance between the liquid cartridge and a cartridge attaching unit of the side of the body of the printing machine is increased. As a result, a relative positional difference may be increased between the information storage device on the side of the liquid cartridge and the reading unit on the side of the apparatus body (the body of the printing machine), whereby a reading failure (a contact failure) may easily occur.

Further, the inertia force of an impact or vibration occurring during transportation is large in the liquid cartridge having the large capacity. Therefore, a seal should be positively made in a liquid supply port (also called a liquid introduction port) through which the liquid is supplied to the side of the body of the printing machine. On the other hand, the seal should be easily removed from the liquid supply port when the liquid cartridge is to be replaced, so that the replacement work can be made easier, and thus, the downtime can be reduced.

SUMMARY OF THE INVENTION

In order to achieve the object, according to an embodiment of the present invention, a liquid container contains liquid to be supplied to a body of an image forming apparatus, and includes a liquid supply port part having a liquid supply port supplying the contained liquid to the outside; and a cap member mounted on the liquid supply port part. The cap member has a sealing part that seals the liquid supply port of the liquid supply port part and a holding part that holds an information storage device that stores information concerning the liquid. The sealing part and the holding part are separably connected together. When the cap member is mounted on the liquid supply port part in a state of the sealing part and the holding part being connected together, the holding part is immovably fixed to the liquid supply port part via the sealing part. When the sealing part has been separated from the holding part, the holding part comes to be able to move with respect to the liquid supply port part.

Other objects, features and advantages of the present invention will become more apparent from the following detailed description when read in conjunction with the accompanying drawings.

DETAILED DESCRIPTION OF THE EMBODIMENTS

Figure 1:
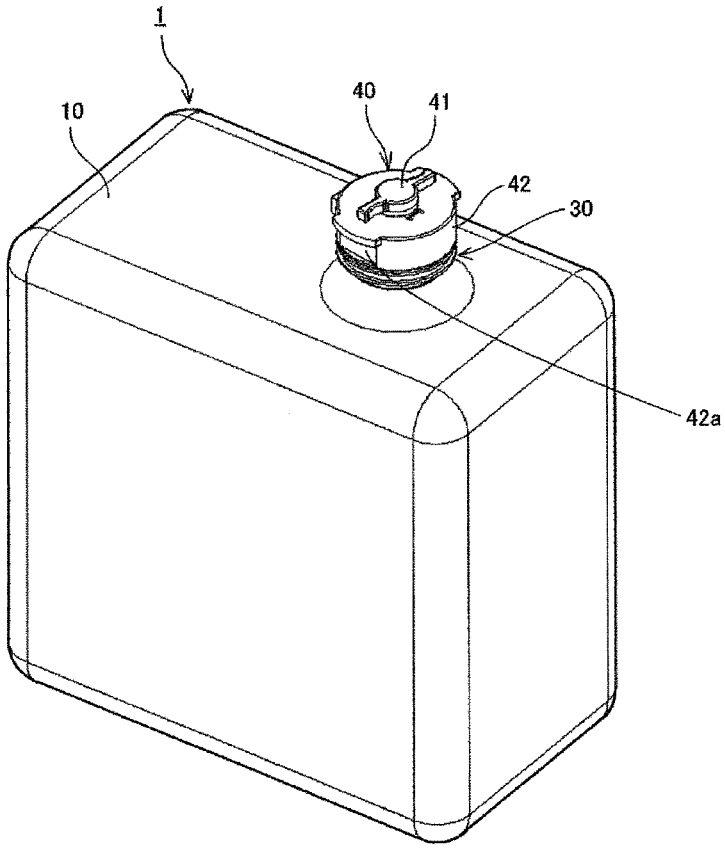
FIG. 1 shows an external appearance perspective view of one example of a liquid cartridge as a liquid container in an embodiment.
Figure 2:
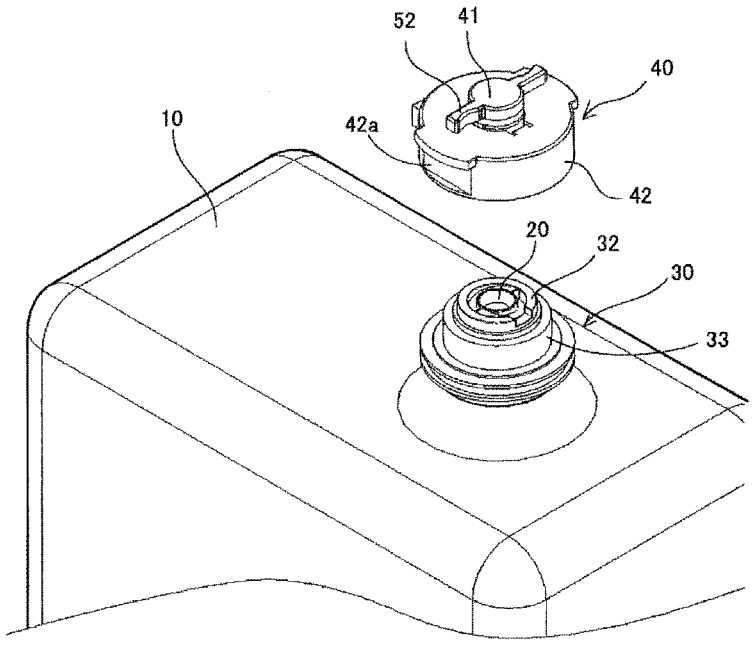
FIG. 2 shows a perspective view of the liquid cartridge before a cap member of a liquid supply port part is mounted.
Figure 3:
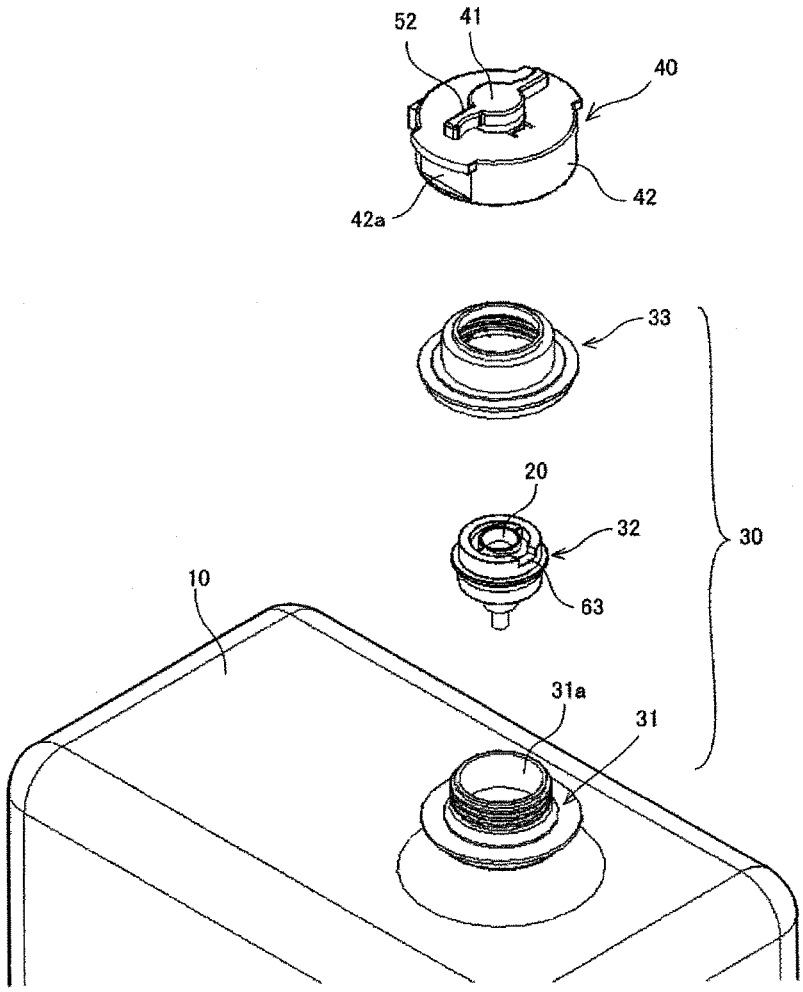
FIG. 3 shows an exploded perspective view of the liquid supply port part.

Below, an embodiment of the present invention will be described using accompanying drawings. Using FIGS. 1, 2 and 3, one example of a liquid cartridge as a liquid container according to the embodiment will be described. FIG. 1 shows an external appearance perspective view of the liquid cartridge. FIG. 2 shows a perspective view of the liquid cartridge before a cap member of a liquid supply port part is mounted. FIG. 3 shows an exploded perspective view of the liquid supply port part.

The liquid cartridge 1 has a liquid containing part 10 containing liquid inside. A liquid supply port part 30 having a liquid supply port 20 supplying the liquid to the outside is provided to the liquid containing part 10. Further, a cap member 40 covering the liquid supply port part 30 is provided.

The liquid supply port part 30 has a port member 31 fixed to the liquid containing part 10; a rotation restriction member 32 placed inside an opening part 31*a* of the port member 31 and having the liquid supply port 20 provided thereto; and a fixing member 33 fixing the rotation restriction member 32 to the inside of the opening part 31*a* of the port member 31 of the liquid containing part 10. The cap member 40 is mounted on the fixing member 33.

It is noted that, when the liquid cartridge 1 is attached to a body of a printing machine, the liquid supply port 20 provided in the rotation restriction member 32 is connected via a tube or the like to a liquid containing member (not shown) for containing the liquid originally contained in the inside of the liquid containing part 10 for supplying the liquid to a recording head of the body of the printing machine via the liquid containing member.

In the configuration of FIG. 1, separate members, i.e., the port member 31, the rotation restriction member 32 and the fixing member 33, are combined together to form the liquid supply port part 30. However, these port member 31, rotation restriction member 32 and fixing member 33 may be made together in integral molding and thus, may be made into one piece. Further, these port member 31, rotation restriction member 32 and fixing member 33 may be made together further with the liquid containing part 10 in integral molding and thus, may be made into one piece including the liquid containing part 10.

Figure 4:
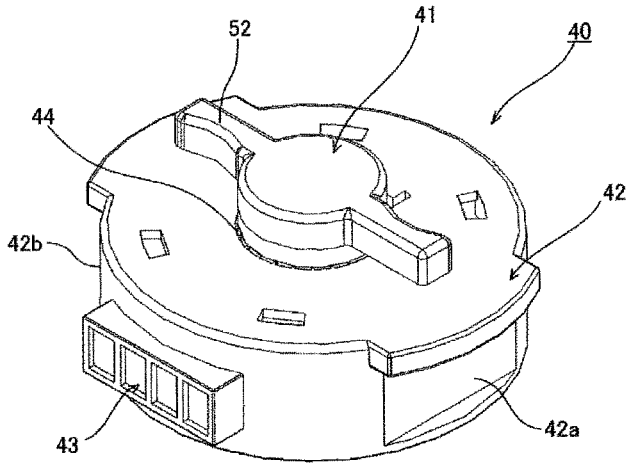
FIG. 4 shows a perspective view of the cap member of an initial state for illustrating the details of the cap member.
Figure 5:
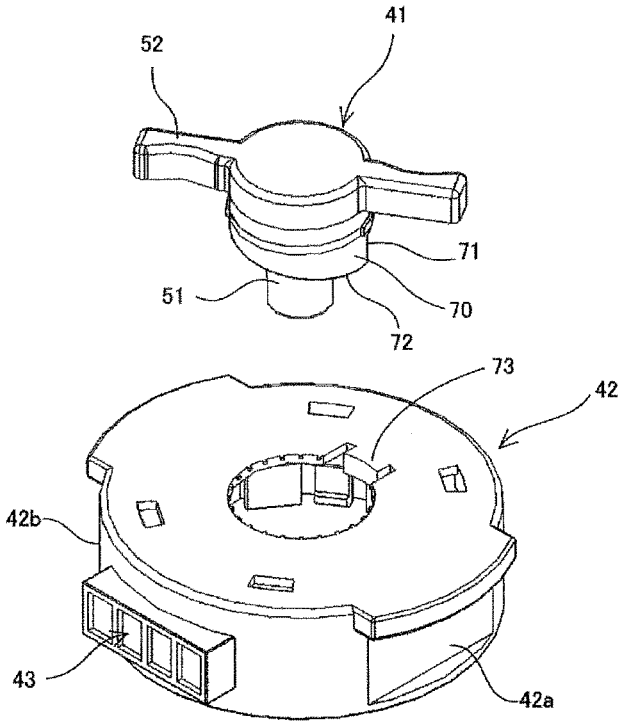
FIG. 5 shows a perspective view of the cap member of a separated state for illustrating the details of the cap member.

Next, the cap member 40 will be described in detail using FIGS. 4 and 5. FIG. 4 shows a perspective view of the cap member 40 of an initial state. FIG. 5 shows a perspective view of the cap member 40 of a separated state.

The cap member 40 has a sealing part 41 for sealing the liquid supply port 20 of the liquid supply port part 30; and a holding part 42 holding an IC chip 43 that is an information storage device storing information concerning the contained liquid.

The sealing part 41 and the holding part 42 are separably connected together by breakable plural bridge parts 44 formed between the outer circumferential surface of the sealing part 41 and the inner circumferential surface of the holding part 42. Thus, by turning the sealing part 41 with respect to the holding part 42, the bridge parts are broken, and thus, it is possible to separate the sealing part 41 from the holding part 42.

The sealing part 41 has a column-shaped plug part 51 to be inserted into and closing the liquid supply port 20; and a lever part 52 extending in a direction perpendicular to the liquid supply direction for turning the plug part 51.

The holding part 42 has guide receiving faces 42*a* and 42*b* coming into contact with guide members 200 (described later using FIG. 12) of the side of the apparatus body (the body of the printing machine) along the attaching direction of attaching the liquid cartridge 1 to the apparatus body at opposite positions on the outer circumferential surface.

During transportation of the liquid cartridge 1, the cap member 40 closes the liquid supply port 20 as a result of the plug part 51 of the sealing part 41 being inserted into the liquid supply port 20 as a result of the cap member 40 being mounted on the liquid supply port part 30. At this time, as a result of the sealing part 41 being immovably fixed to the liquid supply port part 30, the holding part 42 enters a state of being immovably fixed to the liquid supply port part 30 via the sealing part 41.

Then, when the liquid cartridge 1 is to be attached to the body of the printing machine and is to be used, the lever 52 is turned and the sealing part 41 is turned. Thus, the bridge parts 44 between the sealing part 41 and the holding part 42 can be broken, the sealing part 41 can be thus separated from the holding part 42 and can be removed therefrom, the plug part 51 closing the liquid supply port 20 can be removed, and thus, the liquid supply port 20 can be opened.

Figure 6:
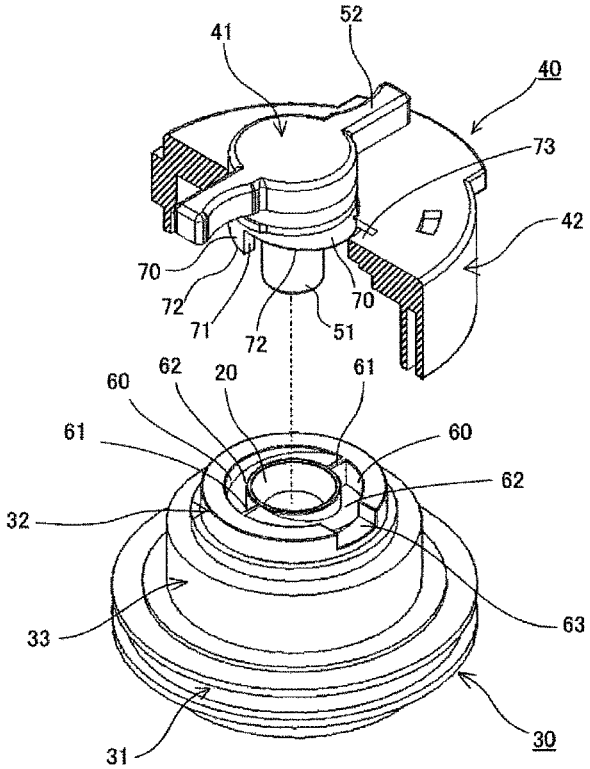
FIG. 6 shows a partially-broken perspective view of the cap member of a state before the cap member is mounted on the liquid supply port part for illustrating the details of the cap member and the liquid supply port part.
Figure 7:
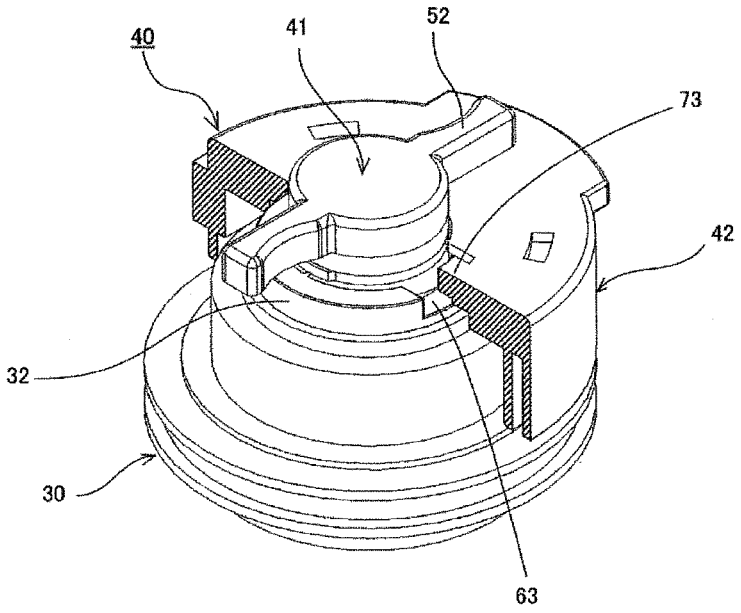
FIG. 7 shows a partially-broken perspective view of a state of the cap member having been mounted on the liquid supply port part for illustrating the details of the cap member and the liquid supply port part.
Figure 8:
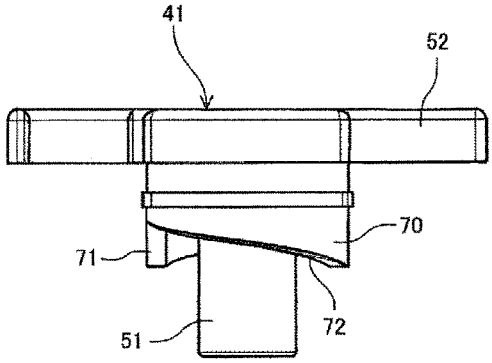
FIG. 8 shows a front view of a sealing part.

Next, details of the cap member 40 and the liquid supply port part 30 will be described using FIGS. 6, 7 and 8. FIG. 6 shows a partially-broken perspective view of the cap member of a state before the cap member 40 is mounted on the liquid supply port part 30. FIG. 7 shows a partially-broken perspective view of a state of the cap member 40 having been mounted on the liquid supply port part 30. FIG. 8 shows a front view of the sealing part 41.

The liquid supply port 20 is provided in the rotation restriction member 32 of the liquid supply port part 30 as mentioned above. As a result of the plug part 51 of the sealing part 41 of the cap member 40 being fitted into the liquid supply port 20, the state of the liquid supply port 20 having been closed is obtained. Thus, the liquid is prevented from leaking during transportation.

At this time, in order to prevent the plug part 51 of the sealing part 41 from being loosened due to vibration during transportation, it is preferable to determine the diameter of the plug part 51 such that pressure is applied to the plug part 51 and the plug part 51 is pressed into the liquid supply port 20.

Further, a groove part 60 is provided at an outer circumferential part of the liquid supply port 20 in the rotation restriction member 32, two rotation restriction faces (abutting faces) 61 are provided separated from each other in a circumferential direction in the groove part 60, and inclined surfaces (tapered faces) 62 are provided on the bottom surface of the groove part 60.

A fitting part 70 is provided to the sealing part 41 of the cap member 40 to be fitted into the groove part 60 provided on the outer circumferential side of the liquid supply port 20 of the rotation restriction member 32. Abutting faces 71 are provided to the fitting part 70 to come into contact with the rotation restriction faces 61, and also, tapered faces 72 are provided to the fitting part 70 to come into contact with the tapered faces 62.

Further, a depression part 63 is provided in the rotation restriction member 32, and a projection part 73 is provided in the holding part 42 of the cap member 40 to be loosely fitted into the depression part 63 with a fixed clearance therebetween. These depression part 63 and projection part 73 act as a restriction part restricting a rotatable range of the holding part 42 in a state of the sealing part 41 having been removed from the holding part 42.

From this configuration, when the cap member 40 is to be mounted on the liquid supply port part 30, the plug part 51 of the sealing part 41 is inserted and pressed into the liquid supply port 20. Thus, the fitting part 70 of the sealing part 41 is fitted into the groove part 60 of the rotation restriction member 32. Then, by turning the sealing part 41 in a state of the tapered faces 62 and the tapered faces 72 coming into contact with each other, the abutting faces 71 come into contact with the rotation restriction faces 61. Thus, the cap member 40 including the sealing part 41 is uniquely positioned, and the cap member 40 is mounted onto the liquid supply port part 30.

At this time, as described above, the projection part 73 provided to the holding part 42 is fitted into the depression part 63 provided to the rotation restriction member 32 loosely with the fixed clearance therebetween. However, the holding part 42 and the sealing part 41 are connected via the bridge parts 49, and thus, the holding part 42 is in a state of not being rotated (i.e., a state of being immovably fixed to the liquid supply port part 30).

Figure 9:
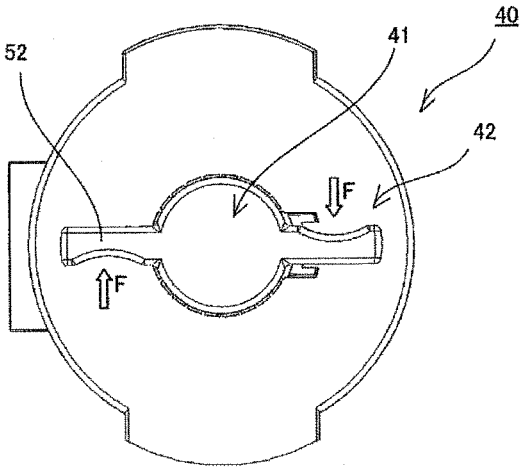
FIG. 9 shows a plan view of the cap member for illustrating operations upon replacement of the liquid container.
Figure 10:
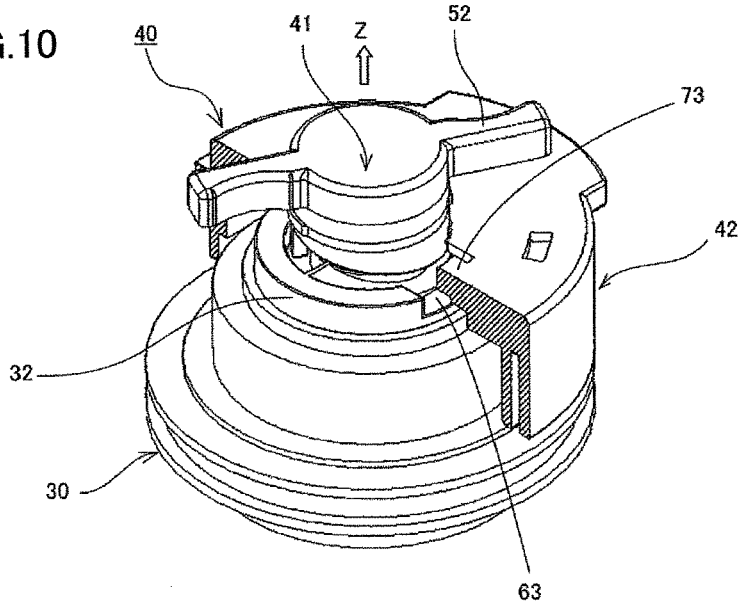
FIG. 10 shows a perspective view of the cap member for illustrating operations upon replacement of the liquid container.

Next, operations at a time of replacing the liquid cartridge 1 will be described using FIGS. 9 and 10. FIG. 9 shows a plan view of the cap member 40 for illustrating the operations. FIG. 10 shows a perspective view of the cap member 40 for illustrating the operations.

It is necessary to open the liquid supply port 20 as a preliminary preparation for attaching the liquid cartridge 1 to the body of the printing machine.

For this purpose, as a result of force being applied to the lever part 52 of the sealing part 41 of the cap member 40 in the directions of the arrows F shown in FIG. 9, the sealing part 41 is turned, and the bridge parts 44 are broken. Simultaneously, the tapered faces 72 of the sealing part 41 move along the tapered faces 62 of the rotation restriction member 32, and, as shown in FIG. 10, force acts on the sealing part 41 in the direction indicated by the arrow Z (i.e., the direction of removing the sealing part 41).

Thus, the plug part 51 that has ensured the sealing performance as a result of pressure having been applied thereto and the plug part 51 having been pressed into the liquid supply port 20 is easily removed from the liquid supply port 20 only as a result of the lever part 52 being rotated, and thus, the liquid supply port 20 is opened.

Thus, the opening work can be easily carried out.

Figure 11:
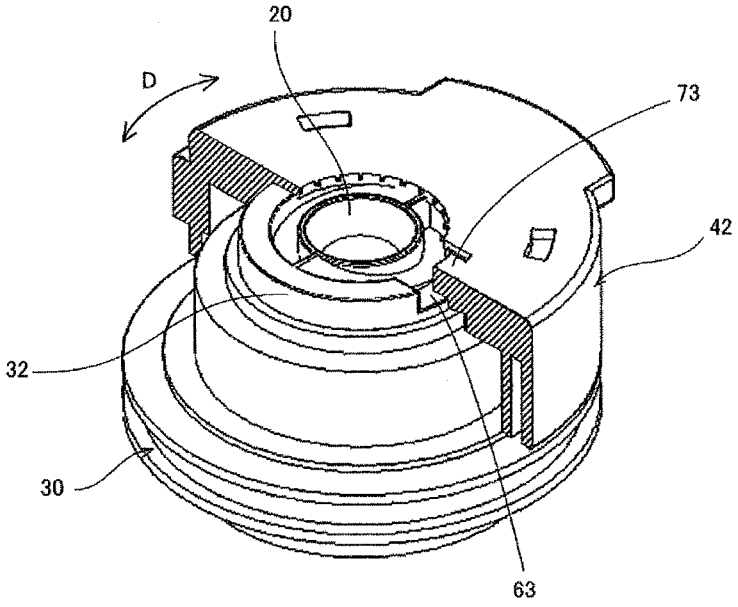
FIG. 11 shows a partially-broken perspective view for illustrating operations of the holding part after the sealing part of the cap member is removed.

Next, operations of the holding part 42 after the sealing part 41 of the cap member 40 is removed will be described using FIG. 11. FIG. 11 shows a partially-broken perspective view for illustrating the operations.

After the sealing part 41 of the cap member 40 is removed from the holding part 42, the holding part 42 is turnable in the directions indicated by the arrows D in FIG. 11. Thus, the IC chip 43 held by the holding part 42 (see FIG. 5) is also movable together with the holding part 42 in the turning directions. Thus, even when there is a position gap between the IC chip 43 and the reading unit of the body of the printing machine, the gap is absorbed, and thus, electrical contact between the IC chip 43 and the reading unit of the body of the printing machine can be positively made.

At this time, the turnable range of the holding part 42 is restricted by the clearance between the projection part 73 of the holding part 42 and the depression part 63 of the rotation restriction member 32. Thus, the holding part 42 is prevented from rotating too much into a state such that attaching to the body of the printing machine would be impossible.

Figure 12:
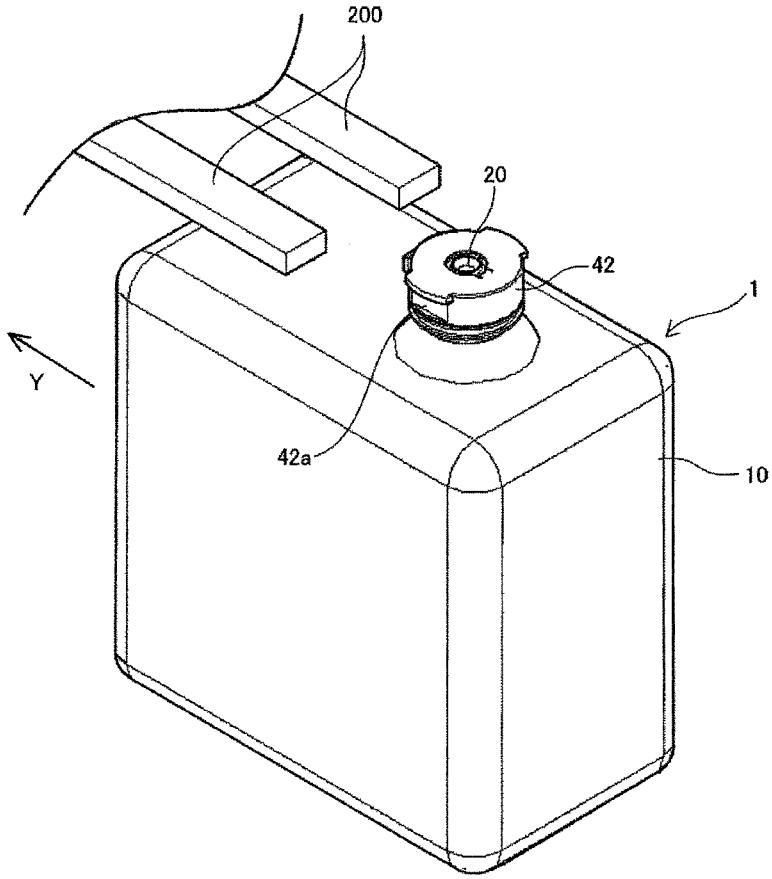
FIG. 12 shows a perspective view for illustrating operations of attaching the liquid cartridge to the body of the printing machine.

Next, operations of attaching the liquid cartridge 1 to the body of the printing machine will be described using FIG. 12. FIG. 12 shows a perspective view for illustrating the attaching operations.

Guide members 200 are provided to the side of the body of the printing machine for guiding the liquid cartridge 1 to be attached to the body of the printing machine.

When the liquid cartridge 1 is attached to the body of the printing machine by moving the liquid cartridge 1 in the direction of the arrow Y, the guide members 200 come into contact with the guide receiving faces 42*a* and 42*b* of the holding part 42. At this time, even if the liquid cartridge 1 is not in ideal position for the guide members 200 of the side of the body of the printing machine, the holding part 42 can be rotated in the directions of the arrows D of FIG. 11. Thus, the position gap is absorbed, and thus, attaching in the direction of the arrow Y can be smoothly carried out. Thus, the workability is improved.

Thus, not only can the sealing performance of the liquid cartridge 1 be ensured during transportation, but also the seal can be opened by easy work and the position gap of the information storage device can be absorbed. Thus, it is possible to carry out the replacement work easily, the workability of the replacement work is improved, and also, it is possible to reduce the downtime.

In the printing machine, materials of sheets of paper used therein for printing are not limited to paper. The sheets of paper may be OHP (Over Head Projector) sheets, cloth, glass, substrates or the like. Thus, any thing capable of ink droplets or other liquid being adhered thereto may be used as the sheets of paper. The sheets of paper may be those referred to as to-be-recorded media, recording media, recording paper, recording sheets of paper or the like. Further, image forming, recording and printing have the same meaning.

The "image forming apparatus" (printing machine) means an apparatus that discharges liquid to a medium such as paper, thread, fiber, fabric, leather, metal, plastic, glass, wood, ceramics or such, and forms an image. "Image forming" means not only giving to a medium an image that has a meaning such as a letter/character, a figure or such, but also giving to a medium an image that does not have a meaning such as a pattern or such (also means merely causing a liquid droplet to land on a medium).

The "ink" (liquid) means, unless otherwise it is in particular limited, not only one called "ink" but is used as a general term of any liquid that is capable of being used to form an image and, for example, may be referred to as recording liquid, fixing solution, liquid or the like. For example, the ink may mean a DNA sample, resist, pattern material, resin, or the like.

Further, the "image" is not only a planar image but also an image given to a thing that has been formed three-dimensionally, or an image formed as a statue or such having a three-dimensional shape formed as a result of being molded three-dimensionally or so.

According to the embodiment, it is possible to improve the workability of the replacement work, and also, ensure the sealing performance of the liquid container.

Thus, the liquid container including the holding part holding the information storage device has been described by the embodiment. However, the present invention is not limited to the specifically disclosed embodiment, and variations and modifications may be made without departing from the scope of the present invention.

The present application is based on Japanese Priority Application No. 2012-097719 filed on Apr. 23, 2012, the entire contents of which are hereby incorporated herein by reference.

What is claimed is:

1. A liquid container containing liquid to be supplied to a body of an image forming apparatus, the liquid container comprising:

a liquid supply port part having a liquid supply port to supply the contained liquid to the outside; and a cap member mounted on the liquid supply port part, wherein the cap member has a sealing part that seals the liquid supply port of the liquid supply port part and a holding part that holds an information storage device that stores information concerning the liquid, the sealing part and the holding part are separably connected together, when the cap member is mounted on the liquid supply port part in a state of the sealing part and the holding part being connected together, the holding part is immovably fixed to the liquid supply port part via the sealing part, when the sealing part has been separated from the holding part, the holding part comes to be able to move with respect to the liquid supply port part, the holding part includes an opening, and when the sealing part is separated from the holding part while the holding part remains in a state of being mounted in the liquid supply port part, said opening of the holding part is opened to the liquid supply port part, and when the holding part is in the state of being mounted in the liquid supply port part while the opening of the holding part is opened to the liquid supply port part, the holding part becomes movable with respect to the liquid supply port part.

2. The liquid container as claimed in claim 1, further comprising:

a restriction part configured to restrict a movable range of the holding part.

3. The liquid container as claimed in claim 2, wherein the sealing part has a lever part extending in a direction perpendicular to a liquid supply direction, and the sealing part is separated from the holding part as a result of the lever part being turned.

4. The liquid container as claimed in claim 1, further comprising:

a bridge part configured to separably connect the sealing part and the holding part and be broken as a result of the sealing part being turned with respect to the holding part, wherein when the cap member is mounted on the liquid supply port part in the state of the sealing part and the holding part being connected by the bridge part, the holding part is immovably fixed to the liquid supply port part via the sealing part, and when the bridge part is broken and the sealing part has been separated from the holding part, the holding part comes to be able to move with respect to the liquid supply port.

5. The liquid container as claimed in claim 4, wherein during transportation of the liquid container, the cap member is mounted on the liquid supply port part, a plug part of the sealing part is inserted into and closes the liquid supply port, and the holding part is immovably fixed to the liquid supply port part via the sealing part as a result of the sealing part being immovably fixed to the liquid supply port while the sealing part and the holding part are connected by the broken part, at a time of the liquid container being attached to the body of the image forming apparatus, the sealing part is turned to break the bridge part, the sealing part is removed from the holding part, the plug part is removed from the liquid supply port, and the liquid supply port is opened, and after the sealing part is removed from the holding part, the holding part can move with respect to the liquid supply port part and the information storage device can move together with the holding part with respect to the liquid supply port part.

6. A liquid container containing liquid to be supplied to a body of an image forming apparatus, the liquid container comprising:

a liquid supply port part having a liquid supply port supplying the contained liquid to the outside; and a cap member mounted on the liquid supply port part, wherein the cap member has a sealing part that seals the liquid supply port of the liquid supply port part and a holding part that holds an information storage device that stores information concerning the liquid, the sealing part and the holding part are separably connected together, when the cap member is mounted on the liquid supply port part in a state of the sealing part and the holding part being connected together, the holding part is immovably fixed to the liquid supply port part via the sealing part, and when the sealing part has been separated from the holding part, the holding part comes to be able to move with respect to the liquid supply port part, wherein the sealing part of the cap member includes:

a plug part configured to be inserted into and close the liquid supply port, and a fitting part configured to be fitted with an outer circumferential part of the liquid supply port of the liquid supply port part.

7. The liquid container as claimed in claim 6, wherein the fitting part of the sealing part has an abutting part that is caused to come into contact with an abutting face provided to a side of the liquid supply port part to be uniquely positioned, the abutting part and the abutting face are in contact with one another via tapered faces, and the sealing part moves in a direction of being removed along the tapered faces as a result of the sealing part being turned.

8. The liquid container as claimed in claim 7, wherein the sealing part has a lever part extending in a direction perpendicular to a liquid supply direction, and the sealing part is separated from the holding part as a result of the lever part being turned.

9. The liquid container as claimed in claim 6, wherein the sealing part has a lever part extending in a direction perpendicular to a liquid supply direction, and the sealing part is separated from the holding part as a result of the lever part being turned.

10. A liquid container containing liquid to be supplied to a body of an image forming apparatus, the liquid container comprising:

a liquid supply port part having a liquid supply port supplying the contained liquid to the outside; and a cap member mounted on the liquid supply port part, wherein the cap member has a sealing part that seals the liquid supply port of the liquid supply port part and a holding part that holds an information storage device that stores information concerning the liquid, the sealing part and the holding part are separably connected together, when the cap member is mounted on the liquid supply port part in a state of the sealing part and the holding part being connected together, the holding part is immovably fixed to the liquid supply port part via the sealing part, and when the sealing part has been separated from the holding part, the holding part comes to be able to move with respect to the liquid supply port part, wherein the sealing part has a lever part extending in a direction perpendicular to a liquid supply direction, and the sealing part is separated from the holding part as a result of the lever part being turned.

* * * * *